United States Patent [19]

Sugimoto et al.

[11] Patent Number: 4,835,442

[45] Date of Patent: May 30, 1989

[54] LAMP FOR GENERATING ULTRAVIOLET RADIATION

[75] Inventors: Takahiro Sugimoto; Hiroki Sasaki, both of Yokohama; Akihiro Yonezawa, Yokosuka; Youichiro Mitsuyuki, Tokyo, all of Japan

[73] Assignee: Kabushiki Kaisha Toshiba, Kawasaki, Japan

[21] Appl. No.: 149,075

[22] Filed: Jan. 27, 1988

[30] Foreign Application Priority Data

| | | | |
|---|---|---|---|
| Jan. 29, 1987 | [JP] | Japan | 62-17298 |
| Feb. 13, 1987 | [JP] | Japan | 62-29686 |
| Mar. 26, 1987 | [JP] | Japan | 62-70328 |

[51] Int. Cl.[4] ..... H01J 17/26

[52] U.S. Cl. ..... 313/565; 313/573; 313/17; 313/25

[58] Field of Search ..... 313/565, 484, 573, 634, 313/231.71, 17, 25

[56] References Cited

U.S. PATENT DOCUMENTS

| | | | |
|---|---|---|---|
| 3,532,045 | 10/1970 | Genahr | 355/56 |
| 3,548,240 | 12/1970 | Spiessens | 313/174 |
| 3,791,735 | 2/1974 | Nakazawa et al. | 356/4 |
| 3,846,628 | 11/1974 | Towne | 250/201 |
| 3,859,518 | 1/1975 | Sander | 250/209 |
| 3,875,401 | 4/1975 | Stauffer | 250/209 |
| 4,129,800 | 12/1978 | van Benthem et al. | 313/634 X |
| 4,349,765 | 9/1982 | Brandli | 313/365 X |
| 4,393,325 | 7/1983 | van der Kooi | 313/490 X |
| 4,527,083 | 7/1985 | Opdebeeck et al. | 313/573 X |
| 4,546,284 | 10/1985 | Renardus et al. | 313/25 |

FOREIGN PATENT DOCUMENTS

| | | |
|---|---|---|
| 0161725 | 11/1985 | European Pat. Off. . |
| 54-71887 | 6/1979 | Japan . |
| 56-160755 | 12/1981 | Japan . |
| 60-143554 | 7/1985 | Japan . |
| 966608 | 8/1964 | United Kingdom . |
| 1097090 | 12/1967 | United Kingdom . |
| 1273663 | 5/1972 | United Kingdom . |
| 1382672 | 2/1975 | United Kingdom . |
| 2033653 | 5/1980 | United Kingdom . |
| 2040554 | 8/1980 | United Kingdom . |

OTHER PUBLICATIONS

British Search Report.

*Primary Examiner*—David K. Moore
*Assistant Examiner*—Michael Horabik
*Attorney, Agent, or Firm*—Cushman, Darby & Cushman

[57] ABSTRACT

A high-efficacy, high power ultraviolet radiation lamp is disclosed. Electrodes are respectively provided at two ends of a discharge tube, and at least a rare gas is sealed in the discharge tube. The discharge tube is curved in a U shape. A reservoir for reserving a radiant material for radiating ultraviolet rays projects from the discharge tube. An isolating section is provided to surround at least the reservoir. The isolating section adjusts the temperature of the reservoir and supplies an appropriate amount of radiant material into the discharge tube.

17 Claims, 8 Drawing Sheets

LAMP FOR GENERATING ULTRAVIOLET RADIATION

BACKGROUND OF THE INVENTION

The present invention relates to a lamp for generating ultraviolet radiation used for purification of various types of gases and liquids and for various types of sterilization processes.

In an ultraviolet radiation lamp, for example, a germicidal lamp, a pair of electrodes are provided at two ends of a discharge bulb, and a rare gas and mercury are sealed in the bulb. The lighting principle of the ultraviolet radiation lamp is completely the same as that of a known fluorescent lamp. The ultraviolet radiation lamp is different from the fluoroescent lamp in that it does not use a phosphor film and that its bulb is made of a glass having a good far ultraviolet ray transmittance of fused quartz. In such an ultraviolet radiation lamp, excited mercury atoms emit far ultraviolet rays. Therefore, the ultraviolet radiation lamp is used in a wide range of applications such as sterilization at waterworks and sewage-treatment plants, sterilization of various types of gases, and production, processing, and treatment of products.

However, in a conventional ultraviolet radiation lamp, an arc loading is 1 Watt per centimeter or less, and a total power input per lamp is as low as about 100 W. As a result, the output is comparatively low.

The germicidal ability of a low power ultraviolet radiation lamp is naturally low. When such a low power ultraviolet radiation lamp uses in a large system such as a purification plant, a large number of lamps are required, and the number of additional components is accordingly increased. Therefore, a demand has recently arisen for development of a high power ultraviolet radiation lamp.

A high power ultraviolet radiation lamp as described in Japanese Patent Disclosure (Kokai) No. 56-160755 is known. This Disclosure discloses an ultaviolet radiation lamp using a light-emitting tube made of ozone-less fused quartz. A pair of electrodes comprising a cathode and an anode are provided at two end of the light-emitting tube. A rare gas and mercury are sealed in the light-emitting tube. The arc length of the light-emitting tube is 300 mm, the lamp current is 4 A, and the power consumption is about 200 W.

However, recently, an ultraviolet radiation lamp having a higher output than that described in the above Disclosure is demanded. Therefore, a high power ultraviolet radiation lamp which can be turned on with an arc length of 1,000 mm or more and a lamp input density (input power per unit arc length) of 3 to 10 W/cm must be developed.

In such a high power ultraviolet radiation lamp, in order to obtain far ultraviolet rays having a wavelength of 254 nm, i.e., germicidal rays, optimal control of the mercury vapor pressure is important. More specifically, in a high power ultraviolet radiation lamp having an arc length of 1,000 mm or more and a lamp input density of 3 to 10 W/cm, the input density (lamp input per unit arc length) during ON time is about 10 times that of a conventional 100-W ultraviolet radiation lamp. Therefore, when the high power ultraviolet radiation lamp is lighting under a natural cooling (air cooling) condition, the tube wall temperature of the light-emitting tube reaches as high as 150° to 250° C. When mercury is sealed in such a light-emitting tube in the same manner as in a conventional fluorescent lamp, an optimum mercury vapor pressure cannot be obtained easily.

According to Japanese Patent Disclosure (Kokai) No. 60-143554, a light-emitting tube is housed in a container. The light-emitting tube is forcibly cooled by flowing water in the container. As a result, the tube wall temperature of the light-emitting tube can be maintained properly to provide an optimum mercury vapor pressure. However, in such a lamp, the flow rate and temperature of water must be strictly controlled. In addition, a means for preventing water from leaking from the container or a means for insulating the electrically conductive portion becomes complex and large. Therefore, such a lamp is not practical.

U.S. Pat. No. 4,349,765 discloses an appendix-like tubular portion for reserving excessive mercury liquid. The mercury vapor pressure is adjusted by controlling the temperature of the tubular portion. However, in this case, the mercury vapor pressure cannot be kept constant depending on the gas temperature in the vicinity of the appendix-like tubular portion or the flowing state of the gas. Therefore, the lamp characteristics can easily fluctuate.

SUMMARY OF THE INVENTION

It is an object of the present invention to provide a lamp for generating ultraviolet radiation wherein the mercury vapor pressure is appropriately controlled to provide high-density ultraviolet rays efficiently.

In order to achieve the above object, according to the present invention, there is provided a lamp for generating ultraviolet radiation comprising:

a discharge tube which has two ends respectively provided with an electrode, the discharge tube being formed in substantially U shape;

a discharge sustaining material comprising mercury contained within the tube for generating substantially ultraviolet radiation;

a reservoir means for holding the material, the reservoir means being connected with and projected from the tube; and means for isolating the reserving means from temperature external conditions by, surrounding the reservoir means, that cause adjustment of a temperature of the reservoir means to supply an appropriate amount of the material to the tube.

With the above arrangement, the ultraviolet-radiant material can be held in the reservoir means as the coldest spot of the discharge tube, and the reservoir means is surrounded by the isolating means. Therefore, the temperature of the reservoir means is not influenced by the temperature of the atmosphere. Since the temperature of the reserving section can thus be kept at a desired value, an ultraviolet radiation lamp having a good radiation efficacy can be obtained.

In order to achieve the above object, according to the present invention, there is also provided another lamp for generating ultraviolet radiation in which a lamp current I (A) satisfies $5 \leqq I \leqq 30$, comprising:

a discharge container which has two ends respectively provided with an electrode and in which at least a rare gas is sealed, the discharge container being curved in a U shape, inner diameter D (mm) of the discharge container satisfying $D \leqq 40$, and inner diameter D and lamp current I satisfying $D - I \leqq 10$;

a reservoir means, provided to project from the discharge container, for holding a radiant material that radiates ultraviolet rays to be supplied to the discharge container; and a means for isolating the reservoir means from external temperature conditions by, surrounding at least the reservoir means that causes adjustment of a temperature of the reservoir means to supply an appropriate amount of the radiant material to the discharge container.

With the above ultraviolet radiation lamp, an ultraviolet radiation lamp having a better radiation efficacy can be obtained.

When mercury is used as the ultraviolet-radiant material, the temperature of the reservoir means may be kept at 45° to 75° C. by the isolating means. When an amalgam is used as the ultraviolet-radiant material, the temperature of the reservoir means may be kept at 100° to 140° C. by the isolating means. In order to keep the reservoir means in these temperature ranges, according to one method, the distance between the reservoir means and the isolating means is kept at a predetermined value. When the projecting length of the reservoir means is set at a predetermined value, a better effect can be obtained.

As described above, in order to set the distance between the reservoir means and isolating means at a predetermined value, a distance setting means may be used.

BRIEF DESCRIPTION OF THE DRAWINGS

Other objects and advantages will be apparent from the following description taken in conjunction with the accompanying drawings in which.

DETAILED DESCRIPTION OF THE PREFERRED EMBODIMENTS

Figure 1:
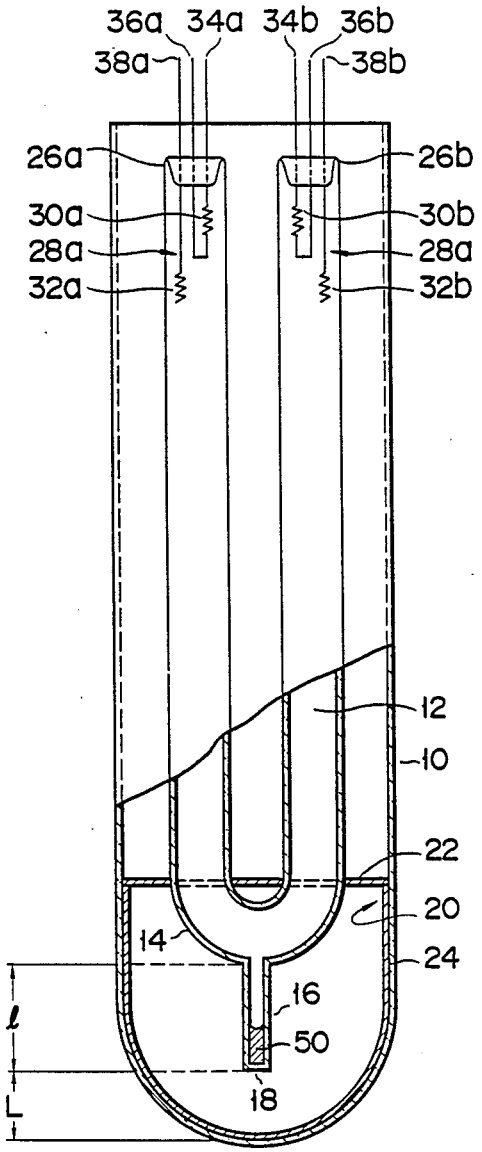
FIG. 1 is a sectional view of a high power ultraviolet radiation lamp according to a first embodiment of the present invention.

A high power ultraviolet radiation lamp according to a first embodiment of the present invention will be described referring to FIGS. 1 to 3. FIG. 1 shows a 500-W high power ultraviolet radiation lamp. U-shaped light-emitting tube (discharge container) 12 made of ozoneless fused quartz is detachably housed in, e.g., fused quartz outer tube 10 having an inner diameter of 80 mm. Tube 12 has an inner diameter of 20 mm and a tube length of 1,300 mm. Reserving means (or projection) 16 having projecting length l of 47.5 mm is formed at substantially the central portion of curved portion 14 of tube 12. Tube 12 is held by support member 20 such that distance L between tip 18 of projection 16 and opposing outer tube 10 is kept at 15 mm. Support member 20 is made of, e.g., stainless steel, and comprises annular disk portion 22 fitted on tube 12 and engaging piece 24. The ends of engaging piece 24 are fitted to disk portion 22 so that engaging piece 24 is abutted against the bottom of tube 10. Support member 20 serves as a defining means for setting a distance L between tip 18 of projection 16 and outer tube 10 at a desired value. The two ends of tube 12 are sealed with hard glass stems **26*a* and 26*b* through an intermediate glass (not shown). Stems 26*a* and 26*b* support electrodes 28*a* and 28*b***, respectively.

Electrode **28*a* consists of cathode 30*a* and anode 32*a* provided at one end of light-emitting tube 12, and electrode 28*b* consists of cathode 30*b* and anode 32*b* provided at the other end of tube 12. Cathode 30*a* and anode 32*b* constitute a pair of electrodes, and cathode 30*b* and anode 32*a*** constitute another pair of electrodes.

Cathode **30*a* is made of a filament coil and has two ends connected to internal lead wires 34*a* and 36*a*. Cathode 30*b* is also made of a filament coil and has two ends connected to internal lead wires 34*b* and 36*b*. Each of filament cathodes 30*a* and 30*b*** is made of, e.g., triple coils to withstand a large current. Although not shown, an oxide including at least one element selected from the group consisting of barium, calcium, and strontium is coated as an electron-emitting material on these coils.

Anodes **32*a* and 32*b* are made of a coil or a solid material and farther project into the discharge space than filament cathodes 30*a* and 30*b*. Anodes 32*a* and 32*b* are connected to internal lead wires 38*a* and 38*b***, respectively.

The electrode distance of this lamp, i.e., the distance between cathode **30*a* provided at one end of light-emitting tube 12 and anode 32*b*** provided at its other end is set at 1,000 mm.

Internal lead wires **34*a*, 36*a*, and 38*a* are hermetically sealed with stem 26*a* and led to the outside through it. Internal lead wires 34*b*, 36*b*, and 38*b* are hermetically sealed with stem 26*b* and led to the outside through it. As shown in FIG. 2, lead wires 34*a* and 36*a* connected to filament cathode 30*a* are connected to two ends of secondary winding 42*a* of transformer 40 outside the lamp and constitute a closed loop. Lead wires 34*b* and 36*b* connected to filament cathode 30*b* are connected to two ends of secondary winding 24*b* of transformer 40 outside the lamp and constitute a closed loop. Lead wire 38*a* connected to anode 32*a* is connected to lead wire 36*a* and simultaneously to one end of remaining secondary winding 46 of transformer 40 outside the lamp through ballast 44. Lead wire 38*b* connected to anode 32*b* is connected to lead wire 36*b* and simultaneously to the other end of another secondary winding 46 of transformer 40** outside the lamp.

Primary winding 48 of transformer 40 is connected to a commercial power source, e.g., a power source of AC 100 V or 200 V.

1 Torr of an argon gas is sealed as a starting rare gas in light-emitting tube 12. 50 mg of mercury as ultraviolet radiant material 50 is sealed in projection 16 as the coldest spot of tube 12.

Figure 2:
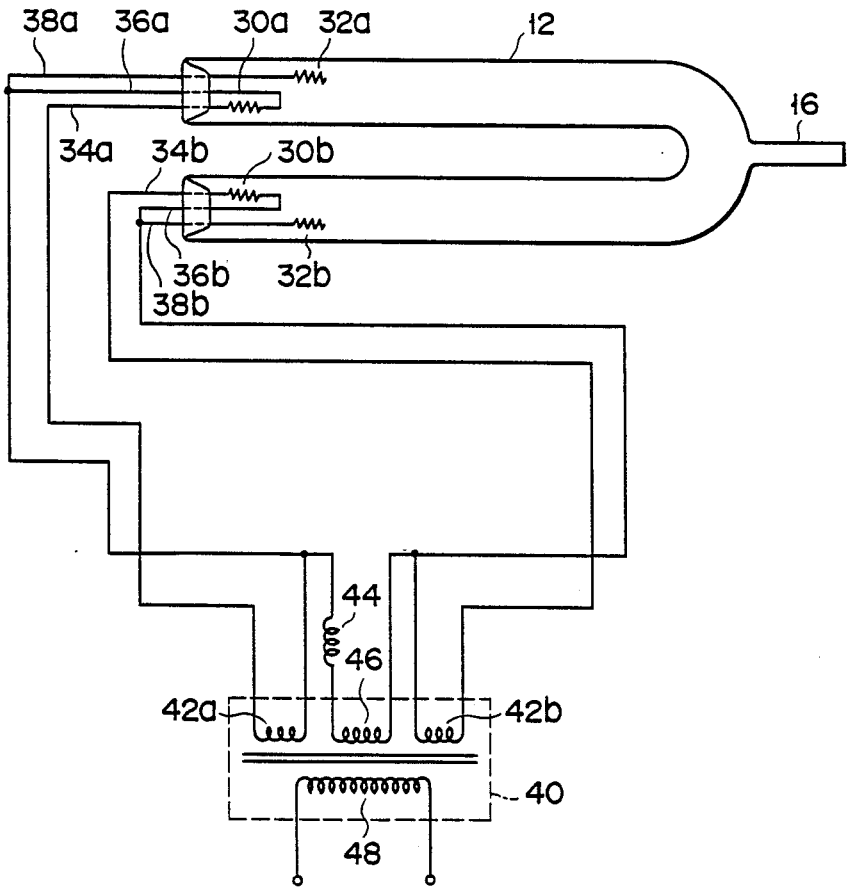
FIG. 2 shows a starter circuit of the high power ultraviolet radiation lamp shown in FIG. 1.

In order to turn on the lamp having the above arrangement, a commercial power source, e.g., AC 100 V or 200 V is supplied to primary winding 48 of transformer 40 as shown in FIG. 2. A potential difference is caused between the two ends of each of secondary windings 24a and 24b of transformer 40, a current is supplied to filament cathodes 30a and 30b to preheat them, and thermoelectrons are thus emitted. Since a predetermined electric field is formed between cathode 30a and anode 32b and between cathode 30b and anode 32b by secondary winding 46, the thermoelectrons are accelerated by the electric field. Thus, electric discharge is caused and a positive column is formed in light-emitting tube 12. The lamp current is set by ballast 44. When tube 12 is turned on with a lamp current of 6 A, the lamp power is 500 W under a natural cooling condition.

The characteristic features of the ultraviolet radiation lamp having the above arrangement will be described. While the ultraviolet radiation lamp of the present invention is ON, the lamp current is 3 to 15 A, which is about 10 times that of the conventional low power ultraviolet radiation lamp. Therefore, cathodes 30a and 30b must emit a large amount of thermoelectrons when light-emitting tube 12 is at a low vapor pressure. Anodes 32a and 32b must collect the large amount of electrons that fly at a considerably high speed since the interior of tube 12 is at a low vapor pressure.

For these purposes, an electron-emitting material is coated on cathodes 30a and 30b and constantly heated by an external power source to emit a large amount of thermoelectrons. Anodes 32a and 32b project in the discharge space farther than filament cathodes 30a and 30b and collect the large amount of electrons that move at a high speed. In this manner, cathodes 30a and 30b and anodes 32a and 32b independently designed to perform their own functions are provided in light-emitting tube 12 of the present invention. When cathodes 30a and 30b and anodes 32a and 32b are independently provided, long-life electrodes can be obtained.

Cathode 30a having the above arrangement is connected to internal lead wires 34a and 36a and cathode 30b is connected to internal lead wires 34b and 36b. Anode 32a is connected to internal lead wire 38a, and anode 32b is connected to internal lead wire 38b. In this manner, in the lamp of the present invention, filament current and lamp current flow through the six internal lead wires. Therefore, even when a large current flows in the lamp, the load is divided, and the electrodes are mechanically supported reliably.

In the lamp having the above arrangement, since the power input density reaches as high as 5 W/cm, the tube wall temperature becomes exceptionally high as a low-pressure mercury lamp. Under these conditions, when mercury is sealed in a lamp having a conventional arrangement, the mercury vapor pressure reaches as high as about $2\times10^{-1}$ Torr, thus falling outside a range of low-pressure mercury vapor discharge.

Therefore, according to the present invention, projection 16 is provided at curved portion 14 of U-shaped light-emitting tube 12 in order to decrease the temperature of the coldest spot to a desired range. The temperature at tip 18 of projection 17 is set to fall within a temperature range for providing a mercury vapor suitable for a low-pressure mercury vapor discharge lamp. It was found through an experiment that, in a large-current low-pressure mercury vapor discharge lamp, the temperature range of the coldest spot for sufficiently providing an effective output having a wavelength of 254 nm was 45° to 75° C. This value is slightly higher than the optimal known temperature range of the coldest spot of a conventional fluorescent lamp.

In the first embodiment, since projection 16 is outside a discharge path, the amount of heat flowing to it is small and its thermal capacity is small. In order to project the temperature in tip 18 of such projection 16 from external conditions, i.e., the influences of the atmosphere to be sterilized, outer tube 10 (also termed surrounding member) is provided to surround light-emitting tube 12 and acts as means for isolating projection 16 from external temperature conditions. With this arrangement, the temperature in tip 18 of projection 16 is prevented from being changed by the environmental temperature or the flow of external air. Since tube 10 is provided, tube 12 can be turned on even when tube 10 housing is immersed in water.

In this embodiment, since projecting length l of projection 16 is 47.5 mm and distance L between tip 18 of projection 16 and opposing outer tube 10 is 15 mm, the temperature of the coldest spot (temperature in tip 18 of projection 16) when the lamp is ON can be maintained at about 56° C. Therefore, a desired amount of mercury vapor is supplied from projection 16 into light-emitting tube 12, and thus a mercury vapor pressure suitable for efficiently radiating germicidal rays, i.e., far ultraviolet rays having a wavelength of 254 nm, can be obtained.

A relationship between projecting length l of projection 16 and the temperature in tip 18 of projection 16 and a relationship between distance L between tip 18 of projection 16 and opposing outer tube 10 and a temperature in tip 18 of projection 16 will be described based on experimental data. The experimental data is shown in Table 1 below and FIG. 3.

Light-emitting tube 12 used for the test of Table 1 has an inner diameter of 20 mm and an arc length of 1,000 mm. 50 mg of mercury is sealed in tube 12. Distance L between tip 18 of projection 16 and opposing outer tube 10 is set to be 15 mm. Table 1 shows changes in temperature in tip 18 of projection 16 using the lamp power as a parameter when projecting length l of projection 16 is changed.

Referring to Table 1, reference symbol A indicates that the temperature in tip 18 falls within a desired range of 45° to 75° C.; B, that the temperature in tip 18 is slightly higher than 75° C.; C, that the temperature in tip 18 is much higher than 75° C.; D, that the temperature in tip 18 is slightly lower than 45° C.; and E, that the temperature in tip 18 is much lower than 45° C.

TABLE 1

| | LAMP POWER (W) | | | | | |
|---|---|---|---|---|---|---|
| l (mm) | 200 | 300 | 500 | 600 | 750 | 1000 |
| 25 | A | A | B | B | C | C |
| 30 | A | A | A | A | B | C |
| 47.5 | E | A | A | A | A | A |
| 65 | E | E | A | A | A | A |
| 70 | E | E | E | D | A | A |
| 75 | E | E | E | E | D | D |

The following facts are apparent From Table 1. More specifically, when projecting length l of projection 16 is set to fall within a range of 30 mm≦l≦47.5 mm, and when the lamp is input is 300 W (lamp input density: 3 W/cm) or more and 500 W (5 W/cm) or less, the temperature in tip 18 of projection 16 can be maintained at 45° C. or more and 75° C. or less, thus efficiently radiating far ultraviolet rays. When projecting length l is set to fall within a range of 47.5 mm<l≦65 mm, and when the lamp input is more than 500 W (lamp input (LD) density: 5 W/cm) and 1,000 W (10 W/cm) or less, the temperature in tip 18 of projection 16 can be maintained at 45° C. or more and 75° C. or less, thus efficiently radiating far ultraviolet rays.

Figure 3:
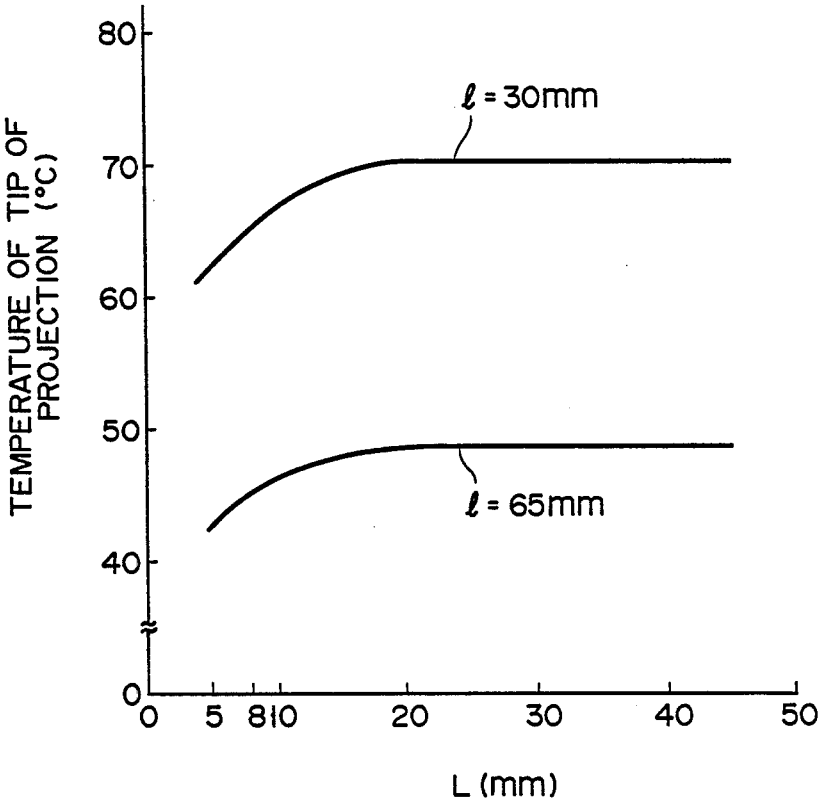
FIG. 3 is a graph showing a relationship between distance L between the tip of the projecting portion and the outer tube and the temperature in the tip of the projecting portion of the lamp shown in FIG. 1.

FIG. 3 shows changes in temperature in tip 18 of projection 16 when projecting length l is set to 30 mm and 65 mm that are lower and upper limit values of an optimal range obtained as the result of the above test and distance L is changed. As is apparent from FIG. 3, the larger distance L, the more likely the temperature in tip 18 is influenced by the ambient temperature outside outer tube 10. When distance L becomes about 20 mm or more, the temperature in tip 18 is not substantially influenced by the temperature outside outer tube 10. When distance L is less than 8 mm, the lamp having projecting length l of 65 mm is influenced by the temperature outside tube 10, and the temperature in tip 18 is lowered to less than 45° C. Therefore, distance L is preferably set to 8 mm or more.

It is apparent from the above tests that when projecting length l is set to fall within a range of 30 mm≦l≦65 mm and distance L is set to 8 mm or more in accordance with the lamp input density, the temperature in tip 18 of projection 16 can be set to 45° C. or more and 75° C. or less. As a result, the mercury vapor pressure in light-emitting tube 12 can be maintained at a value suitable for efficiently radiating far ultraviolet rays having a wavelength of 254 nm.

Figure 9:
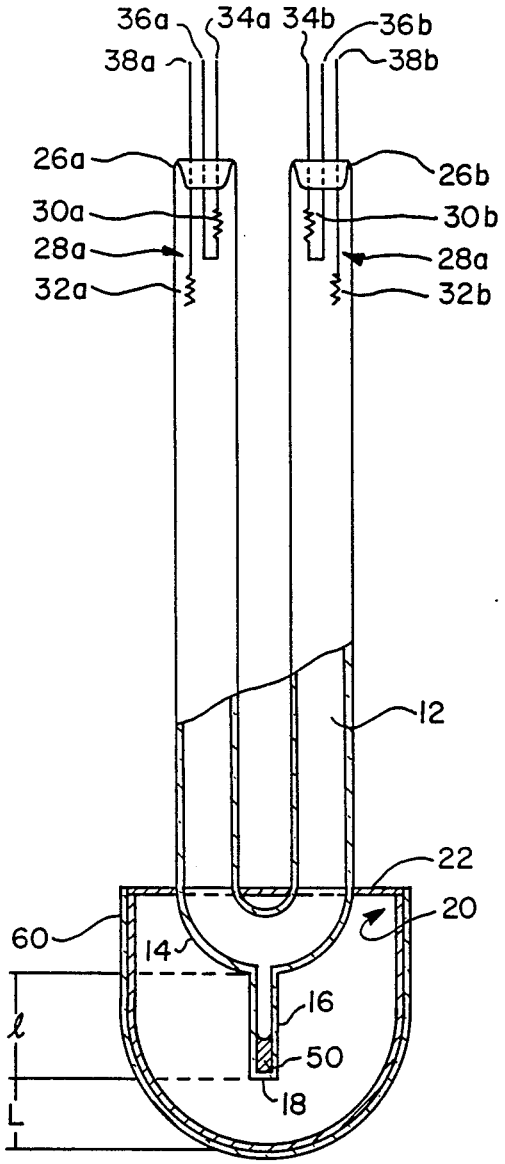

The present invention is not limited to this embodiment. For example, in this embodiment, light-emitting tube 12 is surrounded by outer tube 10. However, in order to achieve the advantages of the present invention, a surrounding member 60 that serves the same function as outer tube 10 may be provided to surround at least projection 16, as shown in FIG. 9 and the temperature of projection 16 may be maintained at a desired value by means of this surrounding member. In this embodiment, distance L between opposing outer tube 10 and tip 18 is set at a desired value by support member 20. However, the shape of support member 20 can be changed in various manners. When such support member 20 is integrally provided around tube 12, tip 18 can be set at a desired position only by inserting tube 12 into tube 10. The electrodes can have a structure other than that described in this embodiment.

The present invention is more effective when it is applied to a ultraviolet radiation lamp having a lamp input density LD of 3 W/cm or more and 10 W/cm or less.

Figure 4:
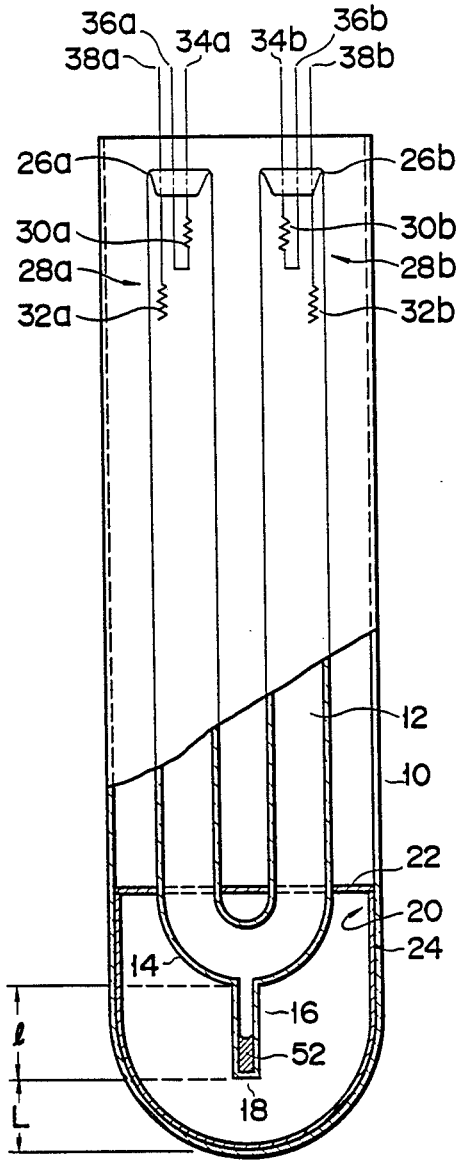
FIG. 4 is a sectional view of a high power ultraviolet radiation lamp according to a second embodiment of the present invention.

A high power ultraviolet radiation lamp according to a second embodiment of the present invention will be described with reference to FIG. 4.

In this embodiment, an amalgam is used as ultraviolet radiating material 52, and projecting length l of projection 16 is set to be 15 mm. Excluding this, the second embodiment is the same as the first embodiment. The same reference numerals denote the same parts as in the first embodiment and a detailed description thereof is omitted.

1 Torr argon gas is filled in a light-emitting tube 12 as a starting rare gas and 500 mg of bismuth-indium-mercury (4 wt. %) amalgam 52 is sealed in light-emitting tube 12 as a supply or mercury vapor. Amalgam 52 is contained in projection 16 as the coldest spot of tube 12.

Amalgam 52 preferably contains at least one metal selected from the group consisting of bismuth, indium, lead, tin, zinc, silver, and cadmium.

In this embodiment, amalgam 52 is used as a means for controlling the mercury vapor pressure. The mercury vapor pressure is determined by the temperature of a portion at which amalgam 52 is provided. With amalgam 52, a desired mercury vapor pressure can be obtained within a higher temperature range than the case when only mercury is used as the ultraviolet radiating material. When various types of amalgams 52 are used, various mercury vapor pressures can be obtained within the same temperature range. Therefore, when amalgam 52 is used, the mercury vapor pressure can be controlled more easily than the case when only mercury is used.

As described above, the mercury vapor pressure differs depending on the temperature of a portion at which amalgam 52 is provided. In order to obtain a constant mercury vapor pressure with a good reproducibility, amalgam 52 must be provided at such a location where its temperature is at a predetermined value during ON time of lamp 12.

In this embodiment, amalgam 52 is reserved in projection 16 provided at curved portion 14 of U-shaped light-emitting tube 12 housed in outer tube 10, projecting length l of projection 16 is set to be 15 mm, and distance L between distal end 18 of projection 16 and opposing tube 10 is set to be 15 mm. Therefore, the temperature of amalgam 52 during ON time of the lamp can be maintained to fall within a preferable range of 100° C. and 140° C., and thus a predetermined amount of mercury emitted from amalgam 52 is supplied to tube 12 from projection 16. Supplied mercury exhibits a vapor pressure suitable for efficiently radiating ultraviolet rays, i.e., far ultraviolet rays having a wavelength of 254 nm.

Figure 5:
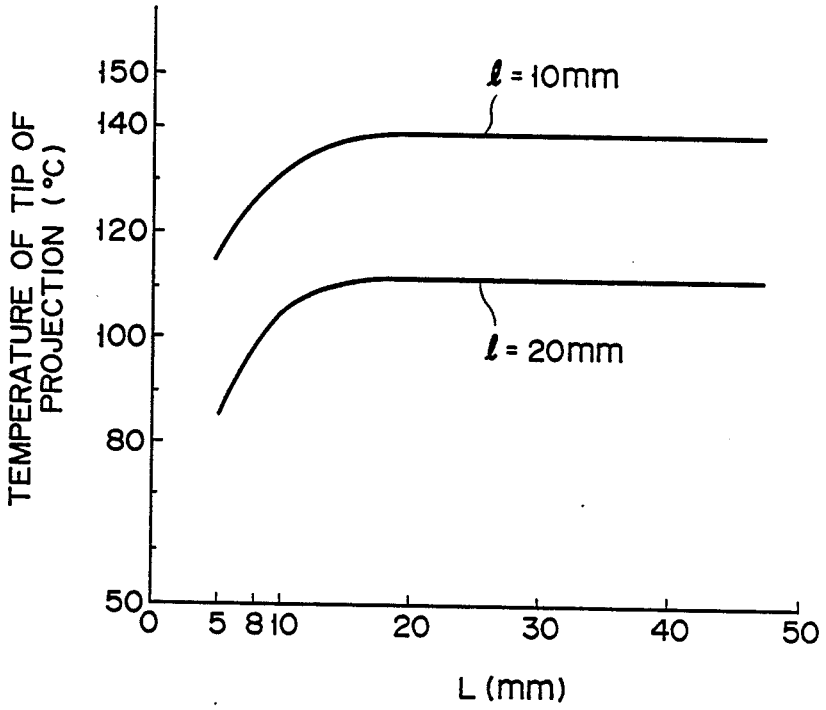
FIG. 5 is a graph showing a relationship between distance L between the tip of the projecting portion and the outer tube and the temperature in the tip of the projecting portion of the lamp shown in FIG. 4.

Table 2 shows a relationship between projecting length l of projection 16 and the temperature in its tip 18. FIG. 5 shows a relationship between distance L between tip 18 and opposing outer tube 10 and the temperature in tip 18 of projection 16. Light-emitting tube 12 of the lamp used in the test of Table 2 has an inner diameter of 20 mm, and an arc length of 1,000 mm. 500 mg of bismuth-indium-mercury (4 wt. %) amalgam 52 is sealed in light-emitting tube 12. Distance L between tip 18 of projection 16 and opposing outer tube 10 is set to be 15 mm. Table 2 shows changes in temperature in tip 18 of projection 16 using the lamp power as a parameter when projecting length l of projection 16 is changed.

Referring to Table 2, reference symbol A indicates that the temperature in tip 18 falls within a desired range of 45° to 75° C.; B, that the temperature in tip 18 is slightly higher than 140° C.; C, that the temperature in tip 18 is much higher than 140° C., D, that the temperature in tip 18 is slightly lower than 100° C.; and E, that the temperature in tip 18 is much lower than 100° C.

TABLE 2

| | LAMP POWER (W) | | | | | |
|---|---|---|---|---|---|---|
| l (mm) | 200 | 300 | 500 | 600 | 750 | 1000 |
| 8 | A | A | B | B | C | C |
| 10 | A | A | A | A | B | C |
| 15 | E | A | A | A | A | A |
| 20 | E | E | A | A | A | A |
| 25 | E | E | E | D | A | A |
| 30 | E | E | E | E | D | D |

The following facts are apparent From Table 2. More specifically, when projecting length l of projection 16 is set to fall within a range of 10 mm≦l≦15 mm, and when the lamp input is 300 W (lamp input density: 3 W/cm) or more and 500 W (5 W/cm) or less, the temperature in tip 18 of projection 16 can be maintained at 100° C. or more and 140° C. or less, thus efficiently radiating far ultraviolet rays. When projecting length l is set to fall within a range of 15 mm<l≦20 mm, and when the lamp input is more than 500 W (lamp input density: (LD) 5 W/cm) and 1,000 W (10 W/cm) or less, the temperature in tip 18 of projection 16 cn be maintained at 100° C. or more and 140° C. or less, thus efficiently radiating far ultraviolet rays.

FIG. 5 shows changes in temperature in tip 18 of projection 16 when projecting length l is set to 10 mm and 20 mm that are lower and upper limit values of an optimal range obtained as the result of the above test and distance L is changed. As is apparent from FIG. 5, the larger distance L, the more likely the temperature in tip 18 is influenced by the ambient temperature outside outer tube 10. When distance L becomes about 20 mm or more, the temperature in tip 18 is not substantially influenced by the temperature outside outer tube 10. When distance L is less than 8 mm, the lamp having projecting length l of 20 mm is influenced by the temperature outside tube 10, and the temperature in tip 18 is lowered to less than 100° C. Therefore, distance L is preferably set to 8 mm or more.

It is apparent from the above tests that when projecting length l is set to fall within a range of 10 mm≦l≦20 mm and distance L is set to 8 mm or more in accordance with the lamp input density, the temperature in tip 18 of projection 16 can be set to 100° C. or more and 140° C. or less. As a result, the mercury vapor pressure in light-emitting tube 12 can be maintained at a value suitable for efficiently radiating far ultraviolet rays having a wavelength of 254 nm.

The present invention is not limited to this embodiment. For example in this embodiment, light-emitting tube 12 is surrounded by outer tube 10. However, in order to achieve the advantages of the present invention, a surrounding member 60 that serves the same function as outer tube 10 may be provided to surround at least projection 16, 12 shown in FIG. 9 and the temperature of projection 16 may be maintained at a desired value by means of this surrounding member. In this embodiment, distance L between tube 10 and tip 18 is set at a desired value by support member 20. However, the shape of support member 20 can be changed in various manners. When such support member 20 is integrally provided around tube 12, tip 18 can be set at a desired position only by inserting tube 12 into tube 10. The electrodes can have a structure other than that described in this embodiment.

The present invention is more effective when it is applied to a ultraviolet radiation lamp having a lamp input density (LD) of 3 W/cm or more and 10 W/cm or less.

An improvement in the high power ultraviolet radiation lamp according to the present invention will be described with reference to FIGS. 6 to 8. The high power ultraviolet radiation lamp used in this description does not have a U-shaped light-emitting tube. However, this lamp can be naturally applied to the ultraviolet radiation lamps according to the first and second embodiments described above.

Figure 6:
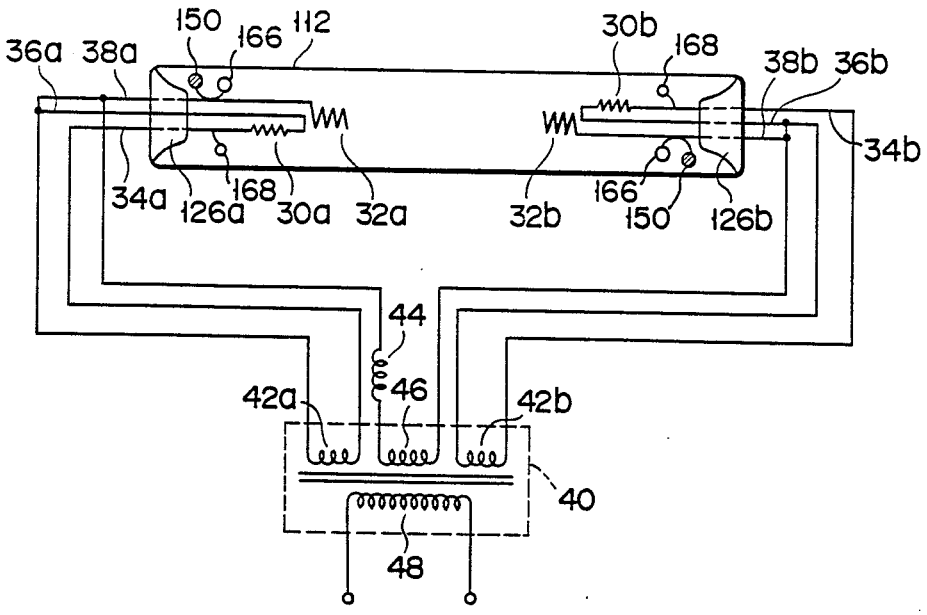
FIG. 6 shows a high power ultraviolet radiation lamp according to a third embodiment of the present invention and its starter circuit.

Referring to FIG. 6, light-emitting tube 112 made of ozone-less fused quartz has inner diameter D of 25 mm and a length of 2,300 mm. Tube 112 is a straight tube. The two ends of tube 112 are sealed with hard glass stems 126*a* and 126*b*. It is preferable that an intermediate glass (not shown) having a thermal expansion coefficient of a value between those of ozone-less fused quartz and hard glass is interposed between ozone-less fused quartz of tube 112 and hard glass of stems 126*a* and 126*b*.

Electrodes 128*a* and 128*b* are provided at one and the other ends, respectively, of light-emitting tube 112. The structures of electrodes 128*a* and 128*b* are identical with those of the first and second embodiments. Therefore, the same reference numerals denote the same parts as in the first and second embodiments and a detailed description thereof is omitted. The electrode distance of tube 112 is set to be 2,000 mm.

Internal lead wires 34*a*, 34*b*, 36*a*, 36*b*, 38*a*, and 38*b* connected to electrodes 128*a* and 128*b* are identical with those of the first and second embodiments. Therefore, the same reference numerals denote the same parts as in the first and second embodiments and a detailed description thereof is omitted. Lead wires 34*a*, 34*b*, 36*a*, 36*b*, 38*a*, and 38*b* are connected to the secondary windings of transformer 40 as in FIG. 3. Therefore, the same reference numerals denote the same parts as in FIG. 3 and a detailed description thereof is omitted.

The primary winding of transformer 40 is connected to a commercial power source, e.g., AC 100 V or 200 V.

One Torr of an argon gas is sealed in light-emitting tube 112 as a starting rare gas, and mercury vapor supply source 150 is housed in tube 112.

Figure 7:
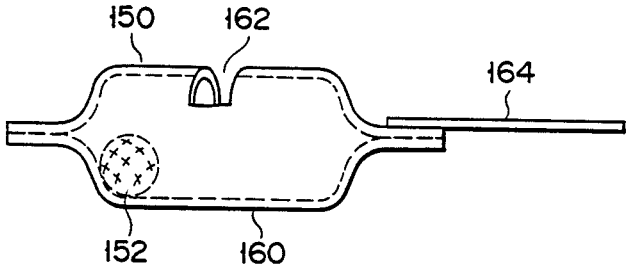
FIG. 7 shows the structure of a metal capsule.

Mercury vapor supply source 150 consists of metal capsule 160 and amalgam 152 stored in it, as shown in FIG. 7. Amalgam 152 is 240 mg of a Bi-In-Hg (Hg: 4 wt. %) amalgam, and metal capsule 160 is made of a 3 mm diameter nickel pipe having closed two ends. Small hole 162 is formed in capsule 160. Hole 162 is of a size not allowing molten amalgam 152 to flow therethrough. Fixing leg 164 is provided to capsule 160.

Fixing leg 164 of metal capsule 160 is welded to one of internal lead wires 34*a*, 34*b*, 36*a*, 36*b*, 38*a*, and 38*b*. Amalgam 152 stored in capsule 160 is located at a position closer to the end side of light-emitting tube 112 than cathodes 30*a* and 30*b* or anodes 32*a* and 32*b*. The temperature of a portion at which amalgam 152 is provided is 100° to 130° C.

Reference numeral 166 denotes an indium-plated molybdenum foil. Since indium on the surface of foil 166 partially forms an alloy with mercury during ON time of the lamp, foil 166 can control the mercury vapor pressure. Reference numeral 168 denotes a getter which is frequently used in a discharge lamp and adsorbs hydrogen.

When the lamp having the above arrangement is to be turned on, a commercial power source, e.g., AC 100 V or 200 V is supplied to primary winding 48 of transformer 40. Cathodes 30*a* and 30*b* are preheated to emit thermoelectrons, thus turning on the lamp. When the lamp is turned on with lamp current I of 7 A, the lamp power is 1,000 W under a natural cooling condition. In the lamp having the above arrangement, inner diameter D of light-emitting tube 112 is set as large as 25 mm. Therefore, even if lamp current I during ON of the lamp is as high as 7 A, the degradation in relative radiation efficacy of the far ultraviolet rays can be sufficiently moderated.

When the lamp current is increased, the current density and the lamp power density per unit arc length are greatly increased compared to a conventional low power ultraviolet radiation lamp. As a result, the wall temperature of light-emitting tube 112 reaches as high as 150° to 300° C. when the lamp is ON. Wall temperature of tube 112 has a temperature distribution and thus the density distribution of the mercury vapor in tube 112 becomes nonuniform. This nonuniformity causes a radiation variation along the longitudinal direction of the lamp. This phenomenon tends to occur when, e.g., the lamp has a large arc length exceeding 1,000 mm or a large input power density (W/cm). In order to prevent such a phenomenon, the pressure of the rare gas in tube 112 may be decreased. In this case, however, the starting voltage may be increased, or scattering of the material constituting the electrodes becomes considerable.

However, when inner diameter D of light-emitting tube 112 is increased than in the conventional lamp, as in the above case, the radiation variation can be prevented without greatly decreasing the rare gas pressure.

Figure 8:
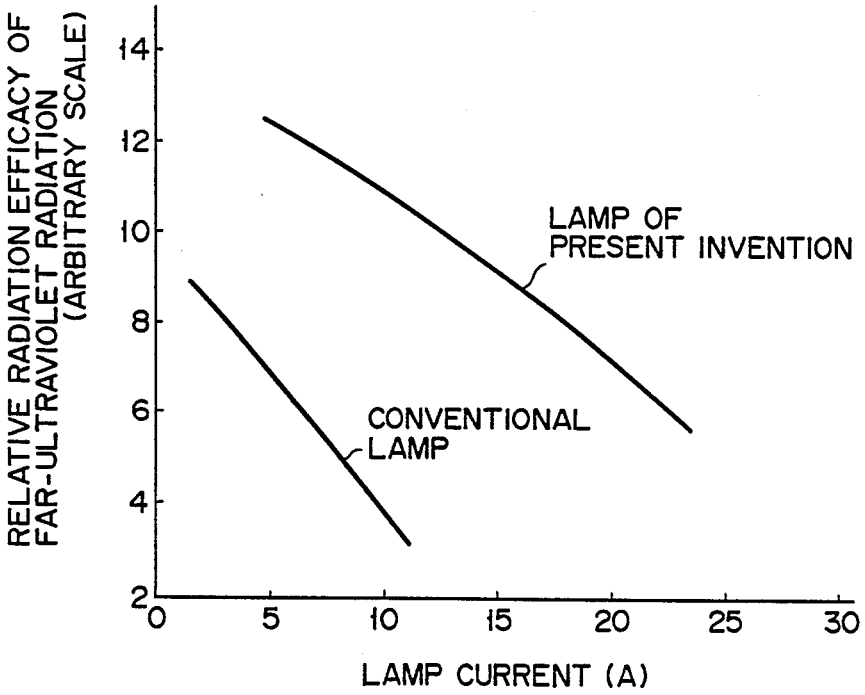
FIG. 8 is a graph showing a relationship between the lamp current and the relative radiation efficacy of the high power ultraviolet radiation lamp shown in FIG. 6 and a conventional ultraviolet radiation lamp.

FIG. 8 shows a decrease in relative radiation efficacy of far ultraviolet radiation of a conventional lamp using a light-emitting tube with inner diameter D of 10 mm and that of a lamp of this embodiment using light-emitting tube with inner diameter D of 25 mm when lamp current I is increased. The relative radiation efficacy of far ultraviolet radiation is a value obtained by dividing the output of far ultraviolet rays having a wavelength near 254 nm by a discharge input (W). An ultraviolet intensity meter "UVR=254" available from Tokyo Optical Co., Ltd. was used as a sensor for detecting an output of far ultraviolet rays having a wavelength of 254 nm. In FIG. 8, the maximum value of the relative radiation efficacy of far ultraviolet rays having a wavelength of 254 nm, when factors such as mercury vapor pressure and rare gas pressure are changed, is defined as a representative value of the relative radiation efficacy of a certain lamp current.

As is understood from FIG. 8, the lamp of this embodiment has a considerably higher absolute radiation efficacy of far ultraviolet radiation than the conventional lamp even when the lamp current is increased. Generally, when the inner diameter of a light-emitting tube is changed without changing the arc length, a lamp current for a lamp having a large inner diameter must be increased, if the lamp power of a lamp having a light-emitting tube with a small inner diameter and that of the lamp having a light-emitting tube with the large inner diameter are to be set to be the same. Therefore, when the lamp power of the lamp of this embodiment is to be set substantially the same as the conventional lamp, a lamp current about twice that of the conventional lamp must be supplied. However, with the lamp of this embodiment, a sufficient relative radiation efficacy can be obtained even when the lamp is turned on with a large current. The relative radiation efficacy of the conventional lamp with the lamp current of 5 A is about 7 whereas that of the lamp of this embodiment with the lamp current of 10 A is about 11.

Table 3 shows the relationship between the relative radiation efficacy and uniformity of radiated light of various types of lamps having various combinations of inner diameters D of the light-emitting tubes and lamp current I, wherein inner diameter D of the light-emitting tube is set to fall within the range of 10 and 50 mm and lamp current I is set to fall within the range of 5 to 35 A. Referring to Table 3, in the columns of the relative radiation efficacy, o indicates that the relative radiation efficacy is 7.5 or more of FIG. 8 and is thus satisfactory; Δ, that the relative radiation efficacy is between 6 and less than 7.5 and is thus unsatisfactory even if it may not be so bad; and x, that the relative radiation efficacy is unsatisfactory. In the columns of the uniformity of radiated light, o indicates that the uniformity of radiated light is good and is thus satisfactory; Δ, that the uniformity is somewhat unsatisfactory; and x, that the uniformity, is unsatisfactory. In the columns of the overall judgment, o indicates that the both the relative radiation efficacy and uniformity of radiated light are o; otherwise, x. It is apparent from Table 3 that when $(D-I) \geqq 10$ is satsified, satisfactory result in both the relative radiation efficacy and uniformity of radiated light can be obtained. However, when lamp current I becomes 30 A or more, a lack of uniformity of radiated light occurs because of the nonuniformity of the mercury vapor density. When inner diameter D of the light-emitting tube becomes 45 mm or more, the mercury vapor layer in the atomic state becomes thick, and the far ultraviolet rays are absorbed by the mercury vapor layer, i.e., a so-called self absorption occurs, thereby degarding the relative radiation efficacy.

When the above results are summarized, a lamp free from radiation variation (nonuniformity of radiated light) and has a high relative radiation efficacy can be obtained when $$5\ (A) \leqq I \leqq 30\ (A)$$

$$D-I \geqq 10$$

$$D \leqq 40\ mm$$

are satisfied.

In this embodiment, the light-emitting tube is a straight tube. However, the present invention can be naturally applied to a lamp having a U-shaped, curved tube. The mercury vapor supply source is not limited to an amalgan, but can be a mercury-sealing container.

According to this embodiment, there is provided a high power ultraviolet radiation lamp wherein a considerable decrease in relative radiation efficacy and radiation variation can be prevented even when the radiation output of the far ultaviolet rays is increased by increasing the lamp current.

TABLE 3

| D | | I(A) | | | | | | |
|---|---|---|---|---|---|---|---|---|
| (mm) | characteristic | 5 | 10 | 15 | 20 | 25 | 30 | 35 |
| 10 | Relative Radiation Efficacy | Δ | x | x | x | x | x | x |
| | Uniformity of Radiated Light | o | o | o | o | o | Δ | Δ |
| | Determination | x | x | x | x | x | x | x |
| 15 | Relative Radiation Efficacy | o | Δ | x | x | x | x | x |
| | Uniformity of Radiated Light | o | o | o | o | o | Δ | Δ |
| | Determination | o | x | x | x | x | x | x |
| 20 | Relative Radiation Efficacy | o | o | Δ | x | x | x | x |
| | Uniformity of Radiated Light | o | o | o | o | o | Δ | Δ |
| | Determination | o | o | x | x | x | x | x |
| 25 | Relative Radiation Efficacy | o | o | o | Δ | x | x | x |
| | Uniformity of Radiated Light | o | o | o | o | o | Δ | Δ |
| | Determination | o | o | o | x | x | x | x |
| 30 | Relative Radiation Efficacy | o | o | o | o | Δ | x | x |
| | Uniformity of Radiated Light | o | o | o | o | o | Δ | Δ |
| | Determination | o | o | o | o | x | x | x |

TABLE 3-continued

| D (mm) | characteristic | I(A) 5 | 10 | 15 | 20 | 25 | 30 | 35 |
|---|---|---|---|---|---|---|---|---|
| 35 | Relative Radiation Efficacy | o | o | o | o | o | Δ | x |
| | Uniformity of Radiated Light | o | o | o | o | o | Δ | Δ |
| | Determination | o | o | o | o | o | x | x |
| 40 | Relative Radiation Efficacy | o | o | o | o | o | o | x |
| | Uniformity of Radiated Light | o | o | o | o | o | Δ | Δ |
| | Determination | o | o | o | o | o | x | x |
| 45 | Relative Radiation Efficacy | Δ | Δ | Δ | Δ | Δ | Δ | x |
| | Uniformity of Radiated Light | o | o | o | o | o | Δ | Δ |
| | Determination | x | x | x | x | x | x | x |
| 50 | Relative Radiation Efficacy | x | x | x | x | x | x | x |
| | Uniformity of Radiated Light | o | o | o | o | o | Δ | Δ |
| | Determination | x | x | x | x | x | x | x |

What is claimed is:

1. A high power ultraviolet radiation lamp in which lamp current I (A) satisfies $5 \leqq I \leqq 30$ comprising:

a discharge container that has two ends respectively provided with electrodes and in which at least a rare gas is sealed, said discharge container being curved in a U shape, and having an inner diameter D (mm) in which $D \leqq 40$, and satisfying the relationship $D-I \geqq 10$;

reservoir means, provided to project from a bottom of said U shaped area of said discharge container, for holding a radiant material that radiates ultraviolet rays to be supplied to said discharge container; and means for isolating said reservoir means from external temperature conditions by surrounding at least said reservoir means with said isolating means so that said reservoir means stays within a predetermined temperature range.

2. A lamp according to claim 1, wherein said isolating means includes an outer tube that surrounds at least said reservoir means at a predetermined distance.

3. A lamp according to claim 2, wherein said predetermined distance is not less than 8 mm.

4. A lamp according to claim 3, wherein the radiant material is mercury.

5. A lamp according to claim 4, wherein the temperature range of said reservoir means is kept at 45° to 75° C. by said isolating means.

6. A lamp according to claim 5, wherein a length of an arc formed in said discharge container is not less than 1,000 mm and lamp input density LD (W/cm) per unit length of the arc length falls within a range of $3 \leqq LD \leqq 10$.

7. A lamp according to claim 6, wherein said reservoir means is a projecting tube projecting from said discharge container, and a projecting length L (mm) of said projecting tube is one of $30 \leqq L \leqq 47.5$ when lamp input density LD satisfies $3 \leqq LD \leqq 5$ and $47.5 \leqq L \leqq 65$ when lamp input density LD satisfies $5 \leqq L \leqq 10$.

8. A lamp according to claim 3, wherein the radiant material is an amalgam.

9. A lamp according to claim 8, wherein the temperature range of said reservoir means is kept at 100° to 140° C. by said isolating means.

10. A lamp according to claim 9, wherein a length of an arc formed in said discharge container is not less than 1,000 mm and lamp input density LD (W/cm) per unit length of the arc length falls within a range of $3 \leqq LD \leqq 10$.

11. A lamp according to claim 10, wherein said reservoir means is a projecting tube projecting from said discharge container, and a projecting length L (mm) of said projecting tube is one of $10 \leqq L \leqq 15$ when lamp input density LD satisfies $3 \leqq LD \leqq 5$ and $15 \leqq L \leqq 20$ when lamp input density LD satisfies $5 \leqq LD \leqq 10$.

12. A lamp for generating ultraviolet radiation comprising:

a discharge tube that has two ends respectively provided with an electrode, said discharge tube being formed substantially in a U shape and capable of forming an arc of not less than 1,000 mm and having a lamp input density LD (W/cm) per unit length of the arc length falling within a range of $3 \leqq LD \leqq 10$;

a mercury discharge sustaining material disposed within said discharge tube for generating substantially ultraviolet radiation reservoir means connected to a bottom of said U shaped area of said discharge tube for holding said mercury, said reservoir means including a projected tube of length L (mm) in which L is one of $30 \leqq L \leqq 47.5$ when $3 \leqq LD \leqq 5$ and $47.5 \leqq L \leqq 65$ when $5 \leqq LD \leqq 10$; and means for isolating said reservoir means from external temperature conditions so that said reservoir stays within a temperature range of 45° to 75° C., said isolating means including an outer tube that surrounds said projected tube and a supporting member for keeping a top of said projecting tube a predetermined distance from said outer tube.

13. A lamp according to claim 12 wherein said predetermined distance is 8 mm.

14. A lamp according to claim 12 wherein said discharge container has an inner diameter D (mm) in which $D \leqq 40$ and a lamp current I(A) that satisfies $5 \leqq I \leqq 30$ and satisfies the relationship $D-I \geqq 10$.

15. A lamp for generating ultraviolet radiation comprising:

a discharge tube that has two ends respectively provided with an electrode, said discharge tube being formed in substantially in a U shape and capable of forming an arc of not less than 1,000 mm and having a lamp input density LD (W/cm) per unit length of the arc length falling within a range of $3 \leqq LD \leqq 10$;

an amalgam disposed within said discharge tube for generating substantially ultraviolet radiation;

reservoir means connected to a bottom of said U shaped area of said discharge tube for holding said amalgam, said reservoir means including a projected tube of length L (mm) in which L is one of $10 \leqq L \leqq 15$ when $3 \leqq LD \leqq 5$ and $15 \leqq L \leqq 20$ when $5 \leqq LD \leqq 10$;

means for isolating said reservoir means from external temperature conditions so that said reservoir stays within a temperature range of 100° to 140° C., said isolating means including an outer tube that surrounds said projected tube and a supporting member for keeping a top of said projecting tube a predetermined distance from said outer tube.

16. A lamp according to claim 15 wherein said predetermined distance is 8 mm.

17. A lamp according to claim 15 wherein said discharge container has an inner diameter D (mm) in which $D \leqq 40$ and a lamp current I(A) that satisfies $5 \leqq I \leqq 30$ and satisfies the relationship to $D-I \geqq 10$.

* * * * *